United States Patent [19]

Pronk

[11] 4,052,295

[45] Oct. 4, 1977

[54] PROCESS FOR THE DESULFURIZATION OF HYDROCARBON OILS WITH WATER VAPOR ADDITION TO THE REACTION ZONE

[75] Inventor: Karel M. A. Pronk, Amsterdam, Netherlands

[73] Assignee: Shell Oil Company, Houston, Tex.

[21] Appl. No.: 656,544

[22] Filed: Feb. 9, 1976

[30] Foreign Application Priority Data

Mar. 24, 1975 Netherlands ..... 7503466

[51] Int. Cl.[2] ..... C10G 23/02

[52] U.S. Cl. ..... 208/211; 208/216; 208/251 H; 208/211

[58] Field of Search ..... 208/216, 209, 251 H, 208/211

[56] References Cited

U.S. PATENT DOCUMENTS

| | | | |
|---|---|---|---|
| 3,112,257 | 11/1963 | Douwes et al. | 208/216 |
| 3,116,234 | 12/1963 | Douwes et al. | 208/216 |
| 3,471,398 | 10/1969 | Borst, Jr. | 208/209 |
| 3,501,396 | 3/1970 | Gatsis | 208/216 |
| 3,536,607 | 10/1970 | Borst, Jr. | 208/251 H |
| 3,617,481 | 11/1971 | Voorhies, Jr. et al. | 208/251 H |
| 3,753,894 | 8/1973 | Shoemaker et al. | 208/216 |

*Primary Examiner*—George Crasanakis
*Attorney, Agent, or Firm*—Ronald R. Reper

[57] ABSTRACT

A hydrodesulfurization process for vanadium-containing ols and certain hydrogenative metal-containing supported catalysts, wherein after deposition of certain amount of vanadium on the catalyst in the absence of added water vapor, water vapor is added to the reaction zone resulting in long-lived, low-cost desulfurization.

10 Claims, No Drawings

PROCESS FOR THE DESULFURIZATION OF HYDROCARBON OILS WITH WATER VAPOR ADDITION TO THE REACTION ZONE

BACKGROUND OF THE INVENTION

The invention relates to a process for the catalytic hydrodesulfurization of heavy hydrocarbon oils.

Heavy hydrocarbon oils such as residues obtained in the distillation of crude petroleum at atmospheric or reduced pressure generally contain a considerable quantity of sulfur compounds. In order to reduce the sulfur content of the heavy oils they may be subjected to a catalytic hydrodesulfurization treatment. This treatment typically is carried out by contacting the heavy oil, together with hydrogen, at elevated temperature and pressure with a catalyst which contains one or more metals having hydrogenative activity, supported on a carrier. One drawback to this direct desulfurization route is that a fairly rapid deactivation of the catalyst generally occurs. This catalyst deactivation is caused, inter alia, because the above-mentioned heavy hydrocarbon oils generally contain a considerable quantity of vanadium compounds, which are deposited on the catalyst during the desulfurization process. As the catalyst activity declines, a higher temperature has to be used in order to maintain the desired degree of desulfurization. In practice, the procedure generally followed is to initiate the process at the lowest possible temperature at which the desired degree of desulfurization is just attained.

In an investigation carried out by the Applicant into the catalytic hydrodesulfurization of vanadium-containing heavy hydrocarbon oils it has been found that the catalyst deactivation which occurs as a result of the deposition of vanadium on the catalyst can be partly compensated by carrying out the process in the presence of a quantity of water vapor corresponding with a water vapor partial pressure during the process of 0.5–30 bar. In addition to the above-mentioned favorable effect on catalyst activity of the presence of water vapor, there are also two less attractive aspects attached to carrying out the catalytic hydrodesulfurization of the present vanadium-containing heavy oils in the presence of water vapor. In the first place, the use of water vapor requires extra energy in order to evaporate the requisite quantity of water, resulting in a rise in the costs of the desulfurization process. Further, in order to enable the process to be carried out at a constant total pressure, the hydrogen partial pressure must be reduced if the desulfurization is carried out in the presence of water vapor. However, reduction of the hydrogen partial pressure during the catalytic hydrodesulfurization of the present heavy oils generally entails lower catalyst activity.

Continued investigation into this subject revealed that in the initial phase of the process, when only a small quantity of vanadium has been deposited on the catalyst and the catalyst deactivation caused by vanadium deposition is therefore still slight, the favorable effect of water vapor on catalyst activity can easily be offset by the two abovementioned less attractive aspects of the use of water vapor. Applicant has found that based upon economic considerations the use of water vapor in the catalytic hydrodesulfurization of vanadium-containing heavy hydrocarbon oils only begins to become attractive once the average vanadium content of the catalyst has increased by at least 5 parts by weight in a preceding operation without the use of water vapor (vanadium content of the catalyst expressed in parts by weight of vanadium per 100 parts by weight of carrier material).

SUMMARY OF THE INVENTION

The invention therefore relates to a process for the catalytic hydrodesulfurization of heavy hydrocarbon oils, in which a vanadium-containing heavy hydrocarbon oil is contacted at elevated temperature and pressure and in the presence of hydrogen with a catalyst which contains one or more metals having hydrogenative activity, supported on a carrier, until the average vanadium content of the catalyst has increased by at least 5 parts by weight, after which the hydrodesulfurization is continued in the presence of a quantity of water vapor corresponding with a water vapor partial pressure during the process of 0.5–30 bar.

DESCRIPTION OF PREFERRED EMBODIMENTS

The process according to the invention is preferably employed with heavy hydrocarbon oils having a vanadium content of more than 10 ppmw, and particularly more than 25 ppmw. Examples of heavy hydrocarbon oils which can very suitably serve as feed for the process according to the invention are crude petroleum and reduced crude petroleum containing the asphaltene fraction of the crude such as residues obtained in the distillation of crude petroleum at atmospheric or reduced pressure, and residues obtained in distillation at atmospheric or reduced pressure of products originating from the catalytic or thermal cracking of heavy hydrocarbon oils.

In the process according to the invention, water vapor is used only after the average vanadium content of the catalyst has increased by at least 5 parts by weight in a preceding operation without water vapor. Preferably, water vapor is only used after the average vanadium content of the catalyst has increased by at least 10 parts by weight and more preferably by at least 15 parts by weight in a preceding operation without water vapor. The use of water vapor can very suitably be effected towards the end of a desulfurization operation without the use of water vapor when the temperature has been raised to approximately the maximum allowable value and the operation under normal circumstances would have to be terminated. The use of water vapor from this point on reduces the requisite temperature considerably and the operation can be continued for a considerable time.

In the process according to the invention the final part is carried out in the presence of a quantity of water vapor corresponding with a water vapor partial pressure during the process 0.5–30 bar. The quantity of water vapor used preferably corresponds with a water vapor partial pressure during the process of 1–15 bar and most preferably 1–10 bar. The requisite quantity of water may be supplied to the gas and/or liquid stream which is passed over the catalyst. For example, water may be added to the heavy oil to be desulfurized or water vapor may be supplied to the hydrogen stream which is supplied to the process. If desired, instead of water a compound may be added, such as lower alcohol, from which water is formed under the prevailing reaction conditions.

Suitable catalysts to be used in the process according to the invention contain one or more metals having hydrogenative activity, supported on a carrier. Preferably, catalysts are used which contain nickel and/or cobalt and, in addition, molybdenum and/or tungsten supported on a carrier. The quantities of these metals are preferably 0.5–20 parts by weight and in particular 0.5–10 parts by weight of nickel and/or cobalt and 2.5–60 parts by weight and preferably 2.0–3.0 parts by weight of molybdenum and/or tungsten per 100 parts by weight of carrier. The atomic ratio of nickel and/or cobalt on the one hand, and molybdenum and/or tungsten, on the other hand, is preferably between 0.1 and 5. Examples of very suitable metal combinations for the present catalysts are nickel/molybdenum, cobalt-/molybdenum, nickel/tungsten and nickel/cobalt-/molybdenum. The metals may be present on the carrier in metallic form or in the form of their oxides or sulfides. Preferably, the catalysts are in the form of their sulfides. Very suitable carriers for the present catalysts are oxides of the elements of the Groups II, III and IV of the periodic system, such as silica, alumina, magnesia and zirconia, or mixtures of the said oxides, such as silica-alumina, silica-magnesia, alumina-magnesia and silica zirconia. Preferred carriers for the present catalysts are aluminas and silica-aluminas.

The process according to the invention is preferably carried out by passing the heavy oil at elevated temperature and pressure, in the presence of hydrogen and, depending on the increase in the average vanadium content of the catalyst, in the presence or in the absence of water vapor, in an upward, downward or radial direction through one or more vertically arranged fixed catalyst beds. The hydrodesulfurization is preferably carried out at a temperature of 300°–475° C, a hydrogen partial pressure of 30–200 bar, a space velocity of 0.1–10 parts by weight of oil per part by volume of catalyst per hour and a hydrogen/oil ratio of 150–2000 Nl $H_2$/kg of oil. Particularly preferred ranges of conditions are: temperatures of 350°–450° C, hydrogen partial pressures of 50–150 bar, space velocities of 0.5–3 parts by weight of oil per part by volume of catalyst per hour and hydrogen/oil ratios of 250–1000 Nl $H_2$/kg of oil.

In order to reduce the rate of deactivation of the desulfurization catalyst, the desulfurization process according to the invention may very suitably be preceded by a demetallization treatment. This demetallization treatment is preferably effected as a catalytic hydrodemetallization treatment. Demetallization of the heavy hydrocarbon oils is further preferably carried out by passing them at elevated temperature and pressure and in the presence of hydrogen, in upward, downward or radial direction, through one or more vertically arranged reactors in which a fixed or moving bed or suitable catalyst particles is present. Although any known hydrodemetallization catalyst can be used, preference is given to catalysts comprising nickel and vanadium on silica such as described in U.S. Pat. No. 3,920,538.

In the process according to the invention, the heavy oil to be desulfurized may be contacted either with a single desulfurization catalyst or consecutively with two different desulfurization catalysts. If the process according to the invention is carried out with the use of only one desulfurization catalyst, it is preferred to select for this purpose a catalyst which meets the requirements stated in the Netherlands patent application No. 7413407. According to this patent application, for the hydrodesulfurization of heavy hydrocarbon oils in the presence of water vapor use is made of a catalyst having such a porosity and particle suze that a given relation between these two parameters and the hydrogen partial pressure used the process is satisfied. If the process according to the invention is carried out with the use of two different desulfurization catalysts, it is preferred to select for this purpose a catalyst combination which meets the requirements stated in the Netherlands patent application No. 7406730. According to this patent application, for the hydrodesulfurization of heavy hydrocarbon oils in the presence of water vapor use is made of a catalyst composition of which each catalyst has a porosity and particle size within given limits which are dependent on the porosity and particle size of the other catalyst in the combination and on the hydrogen partial pressure used, which catalysts are used in a given volumetric ratio. Finally, if the process according to the invention is carried out with the use of two different desulfurization catalysts, and the process is furthermore preceded by a catalytic hydrodemetallization treatment, for this purpose it is preferred to choose a catalyst combination consisting of three catalysts, which combination satisfies the requirements stated in the Netherlands patent application No. 7502491. According to this last application, which was filed as an addition to the above-mentioned Netherlands patent application No. 7406730, for the hydrodemetallization treatment followed by hydrodesulfurization in the presence of water vapor, use is made of a catalyst combination consisting of consecutively one demetallization catalyst and two desulfurization catalysts of which the porosity, particle size and volumetric ratio used must satisfy given requirements.

The invention will now be elucidated with reference to the following Example.

EXAMPLE

Two catalysts (catalysts I and II) were used for the hydrodesulfurization of two vanadium-containing residual hydrocarbon oils (oils A and B). The desulfurization of the oils was carried out by passing them at elevated temperature and pressure, in the presence of hydrogen and in the presence or absence of water vapor, in downward direction through a vertically arranged cylindrical fixed catalyst bed.

The experiments were carried out in pairs. In each pair of experiments, the same oil was desulfurized over the same catalyst and at the same initial temperature, total pressure, space velocity and gas rate until the same sulfur content in the product was attained. In one of the two experiments, no water vapor was used. In the other experiment, the desulfurization was initially carried out without the use of water vapor and subsequently in the presence of water vapor until the end of the experiment. A constant total pressure was maintained during each experiment.

The desulfurization experiments were carried out at an initial temperature of 360° ± 5° C, a space velocity of 0.7 $kg.l^{-1}.h^{-1}$, a total pressure of 100–150 bar and a water vapor partial pressure varying from 0–10 bar. In order to prepare a product with a constant sulfur content, the temperature had to be gradually raised in the course of the experiment. The desulfurization experiments were terminated at the moment when a temperature in excess of 420° C was to prepare a product with the desired sulfur content.

The composition and the properties of the catalysts, which were used in the form of their sulfides, are shown in Table A. The catalysts satisfied the requirements stated in the above-mentioned Netherlands patent application No. 7413047. The two residual oils involved in the investigation are described in more detail below. The results of the desulfurization experiments are stated below.

Oil A

Oil with a total vanadium and nickel content of 75 ppmw and a sulfur content of 4.0% by weight, obtained as a residue in the distillation at atmospheric pressure of a Middle East crude oil.

Oil B

Oil with a total vanadium and nickel content of 225 ppmw and a sulfur content of 2.0% by weight, obtained as a residue in the distillation at atmospheric pressure of a Caribbean crude oil.

TABLE A

| Cat. No. | Metal load, pbw per 100 pbw of carrier Co | Ni | Mo | Carrier | Pore volume, ml/g | Pore volume in pores with a diam. ≧0.7 × p and ≦1.7 × p, ml/g | Surface area, $m^2/g$ |
|---|---|---|---|---|---|---|---|
| I | — | 3.5 | 9.3 | $Al_2O_3$ | 0.48 | 0.44 | 297 |
| II | 4.6 | — | 11.3 | $Al_2O_3$ | 0.56 | 0.49 | 160 |

| Cat. No. | % of the pore volume in pores with a diam. <0.7 × p | % of the pore volume in pores with a diam. >0.7 × p | % of the pore volume in pores with a diam. >100 nm | p, nm x) | d, nm x) |
|---|---|---|---|---|---|
| I | 3.0 | 3.3 | 5.9 | 4.8 | 0.8 |
| II | 13.8 | 1.7 | 1.3 | 16.7 | 1.5 |

x) p = specific average pore diameter and d = specific average particle diameter (as stated in the above-mentioned Netherlands patent application No. 7413047 and determined as described in the Netherlands patent applicatin No. 7214397).

RESULTS

Experiment 1 and 1'

Catalyst used: I
OIl used: A
Sulfur content in product: 0.5%w

Experiment 1 was carried out for 1,200 hours at a hydrogen partial pressure ($P_{H_2}$) of 150 bar. After 1,200 hours, when the requisite temperature had risen to 400° C and the average vanadium content of the catalyst was 7 pbw per 100 pbw of carrier, water vapor was added in a quantity corresponding with a water partial pressure ($P_{H_2O}$) in the process of 5 bar. The requisite temperature fell to 392° C as a result. The experiment was continued at a $P_{H_2}$ of 145 bar and $P_{H_2O}$ of 5 bar. The catalyst achieved a life of 2,000 hours.

Experiment 1' was carried out at a $P_{H_2}$ of 150 bar, without the addition of water vapor. The catalyst achived a life of 1,500 hours.

Experiment 2 and 2'

Catalyst used: I
Oil used: B
Sulfur content in product: 0.5%w

Experiment 2 was carried out for 1,100 hours at a $P_{H_2}$ of 100 bar. After 1,100 hours, when the requisite temperature had risen to 410° C and the average vanadium content of the catalyst was 15 pbw per 100 pbw of carrier, water vapor was added in a quantity corresponding with a $P_{H_2O}$ in the process of 10 bar. The requisite temperature fell to 395° C as a result. The experiment was continued at a $P_{H_2}$ of 90 bar and a $P_{H_2O}$ of 10 bar. The catalyst achieved a life of 1,600 hours.

Experiment 2' was carried out at a $P_{H_2}$ of 100 bar without the addition of water vapor. The catalyst achieved a life of 1,250 hours.

Experiment 3 and 3'

Catalyst used: II
Oil used: A
Sulfur content in the product: 1.0%w

Experiment 3 was carried out for 2,500 hours at a hydrogen partial pressure ($P_{H_2}$) of 150 bar. After 2,500 hours, when the requisite temperature had risen to 395° C and the average vanadium content of the catalyst was 12 pbw per 100 pbw of carrier, water vapor was added in a quantity corresponding with a water partial pressure ($P_{H_2O}$) in the process of 3 bar. The requisite temperature fell to a 390° C as a result. The experiment was continued at a $P_{H_2}$ of 147 bar and a $P_{H_2O}$ of 3 bar. The catalyst achieved a life of 4,300 hours.

Experiment 3' was carried out at a $P_{H_2}$ of 150 bar without the addition of water vapor. The catalyst achieved a life of 3,500 hours.

Of the above-mentioned experiments, only experiments 1, 2 and 3 are experiments according to the present patent application. The experiments 1', 2' and 3' were included for the purpose of comparison.

The favorable effect of the presence of water vapor on the performance of the catalysts becomes evident upon comparison of the results of the experiments which are shown in pairs above.

What is claimed is:

1. A continuous process for the catalytic hydrodesulfurization of vanadium-containing heavy hydrocarbon oils which comprises (a) contacting in a reaction zone vanadium-containing heavy hydrocarbon oil at elevated temperature and pressure with hydrogen and with a catalyst which contains from about 0.5 to 20 parts by weight of nickel and/or cobalt and from about 2.5 to 60 parts by weight of molybdenum and/or tungsten per 100 parts by weight of a porous carrier selected from the group consisting of alumina, silica, magnesia, zirconia and mixtures thereof and in the absence of added water vapor until the average vanadium content of the catalyst has increased during said contacting by at least 5 parts by weight per 100 parts by weight of said catalyst and (b) adding and maintaining a quantity of water vapor to the reaction zone after said vanadium content of said catalyst has increased during said contacting by at least 5 parts by weight per 100 parts by weight of said catalyst, said quantity of water corresponding to a water vapor partial pressure in the range from 0.5 to 30 bar during the process.

2. A process as in claim 1, wherein the addition of water vapor to said hydrodesulfurization is started in said process after the average vanadium content of a catalyst has increased by at least 10 parts by weight.

3. A process as in claim 1, wherein the desulfurization temperature has been increased to approximately the maximum allowable value in said hydrodesulfurization prior to the addition of said water vapor.

4. A process as in claim 1, wherein said quantity of water vapor added to said desulfurization process corresponds to a water vapor partial pressure in the range from 1 to 15 bar during the process.

5. A process as in claim 1, wherein in the catalyst the atomic ratio of said nickel and/or cobalt to said molybdenum and/or tungsten is between 0.1 and 5.

6. A process as in claim 1, wherein said catalyst is in sulfide form and the carrier is selected from the group consisting of silica and silica-alumina.

7. A process as in claim 1, wherein the temperature is in the range of 300°–475° C, the hydrogen partial pressure is in the range of 30–200 bar, the space velocity is in the range of 0.1–10 parts by weight of oil per part by volume of catalyst per hour and the hydrogen/oil ratio is in the range of 150–2,000 Nl $H_2$/kg of oil.

8. A process as in claim 7 wherein the temperature is in the range of 350°–450° C, the hydrogen partial pressure is in the range of 50–150 bar, the space velocity is in the range of 0.5–3 parts by weight of oil per part by volume of catalyst per hour and the hydrogen/oil ratio is in the range of 250–1,000 Nl $H_2$/kg of oil.

9. A process as in claim 1, wherein the desulfurization step (a) is preceded by a demetallization treatment of the heavy hydrocarbon oil.

10. A process as in claim 9, wherein the desulfurization step (a) is preceded by a catalytic hydrodemetallization treatment of the heavy hydrocarbon oil over a nickel and vanadium on silica demetallization catalyst.

* * * * *